United States Patent [19]

Fujii et al.

[11] Patent Number: 4,513,696

[45] Date of Patent: Apr. 30, 1985

[54] APPARATUS FOR CHARGING COOLING LIQUID TO ENGINE COOLING SYSTEM

[75] Inventors: Hiroshi Fujii; Toshiharu Sakamoto, both of Hiroshima, Japan

[73] Assignee: Toyo Kogyo Co., Ltd., Hiroshima, Japan

[21] Appl. No.: 496,945

[22] Filed: May 23, 1983

[30] Foreign Application Priority Data

May 24, 1982 [JP] Japan ..... 57-87737
May 24, 1982 [JP] Japan ..... 57-87738

[51] Int. Cl.[3] ..... F01P 11/06
[52] U.S. Cl. ..... 123/41.02; 123/41.42
[58] Field of Search ..... 123/41.01, 41.14, 41.42; 165/95; 222/144.5, 145

[56] References Cited

U.S. PATENT DOCUMENTS 3,991,911 11/1976 Shannon et al. ..... 222/144.5
4,019,653 4/1977 Scherer et al. ..... 222/144.5

FOREIGN PATENT DOCUMENTS 5644415 9/1979 Japan .

*Primary Examiner*—William A. Cuchlinski, Jr.
*Attorney, Agent, or Firm*—Fleit, Jacobson, Cohn & Price

[57] ABSTRACT

An apparatus for charging a cooling liquid to an engine cooling system. The apparatus comprises an additive reservoir for storing an additive such as an anti-icing agent, a cooling water reservoir for storing cooling water, a filler head adapted to be connected with a coolant inlet of an automobile engine cooling system, additive conduits extending between the additive reservoir and the fillter head, cooling water conduits extending between the cooling water reservoir. Additive control valves are provided in the additive conduits for controlling the quantity of the additive supplied to the engine cooling system in accordance with the capacity of the cooling system and a desired concentration of the additive. Cooling water control valves are also provided in the cooling water conduits for controlling the quantity of the cooling water supplied to the engine cooling system in accordance with the capacity of the cooling system and the desired concentration of the additive, whereby the cooling water is charged to the engine cooling system with the desired concentration of the additive.

10 Claims, 4 Drawing Figures

| FIG.1A | FIG.1B |
|---|---|

APPARATUS FOR CHARGING COOLING LIQUID TO ENGINE COOLING SYSTEM

The present invention relates to an apparatus for charging cooling liquid to cooling systems of internal combustion engines. More particularly, the present invention pertains to an engine cooling liquid charging apparatus suitable for use in automobile manufacturing plants although it is not intended to limit the invention to such a use.

In liquid-cooled internal combustion engines, the cooling systems are charged with cooling liquid which may contain additives such as anti-icing agents, the concentrations of such additives being varied depending on the weather conditions of the sites where the automobiles carrying the engines are brought into service. Conventionally, several types of cooling liquids are provided with different additive concentrations and such cooling liquids are selected depending on the sites to be charged to the engine cooling systems. Thus, conventional automobile assembling plants have been provided with a plurality of cooling liquid tanks respectively containing cooling liquids of different additive concentrations, for example, of 20%, 35%, 45% and 55% additive concentrations so that one of the tanks is selected to supply the cooling liquid contained therein to the engine cooling system to thereby charging the cooling system with cooling liquid of a desired additive concentration. However, the conventional procedure has been disadvantageous in that it requires a large space for the liquid tanks and complicated pipings for providing conduits for drawing cooling liquids from the tanks.

It is therefore an object of the present invention to provide an engine cooling liquid charging system which requires less space as compared with conventional apparatus.

Another object of the present invention is to provide an engine cooling liquid charging system which can charge engine cooling systems with cooling liquids of desired additive concentrations.

A further object of the present invention is to provide an engine cooling apparatus which can charge a cooling liquid to an engine cooling system with uniformly mixed additives.

According to the present invention, the above and other objects can be accomplished by an apparatus for charging a cooling liquid to an engine cooling system, which comprises additive reservoir means for storing at least one additive, cooling water reservoir means for storing cooling water, filler head means adapted to be connected with coolant inlet means of an automobile engine cooling system having a known volumetric capacity, additive conduit means extending between said additive reservoir means and said filler head means, cooling water conduit means extending between said cooling water reservoir means, additive control means provided in said additive conduit means for controlling quantity of the additive supplied to the engine cooling system in accordance with the capacity of the cooling system and a desired concentration of the additive, cooling water control means provided in said cooling water conduit means for controlling quantity of the cooling water supplied to the engine cooling system in accordance with the capacity of the cooling system and the desired concentration of the additive, whereby the cooling water is charged to the engine cooling system with the desired concentration of the additive.

According to the features of the present invention, it is only required to provide one reservoir for one additive in addition to the cooling water reservoir and a desired additive concentration can be obtained simply by controlling the quantities of the cooling water and the additive supplied to the engine cooling system. The additive and cooling water control means may include control valve means provided in the respective conduit means and operation means may be provided for controlling the control valve means in accordance with the capacity of the engine cooling system and the desired additive concentration. It should of course be noted that the present invention is applicable to an apparatus for charging the cooling water with two or more additives such as anti-icing agent and anti-corrosion agent.

Where the additive is supplied to the engine cooling system separately from the cooling water, there may be a possibility that the additive is not uniformly mixed with the water so that a problem of local icing may occur. In order to present the possible problem, it is preferable that the additive control means includes means for controlling rate of supply of the additive so that additive supply time becomes substantially the same as cooling water supply time. For the purpose, the additive conduit means may be provided with variable orifice means. Alternatively, the additive conduit means may have a plurality of parallely arranged orifices and valve means for selectively using the orifices.

The above and other objects and features of the present invention will become apparent from the following description of a preferred embodiment taking reference to the accompanying drawings, in which.

Figures 1, 1A:
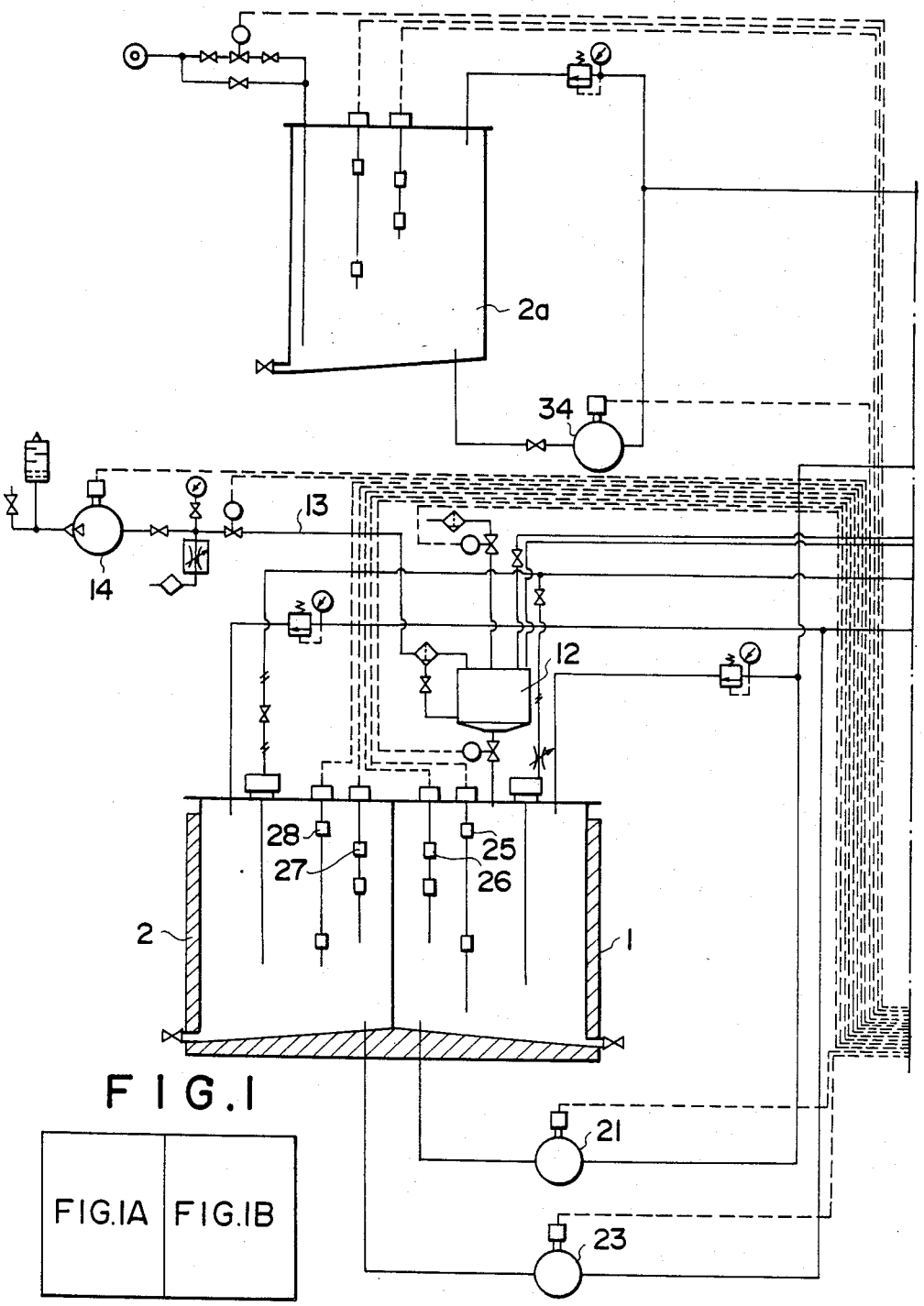
FIGS. 1A and 1B are a diagram showing an engine cooling water charging apparatus in accordance with one embodiment of the present invention.
Figure 1B:
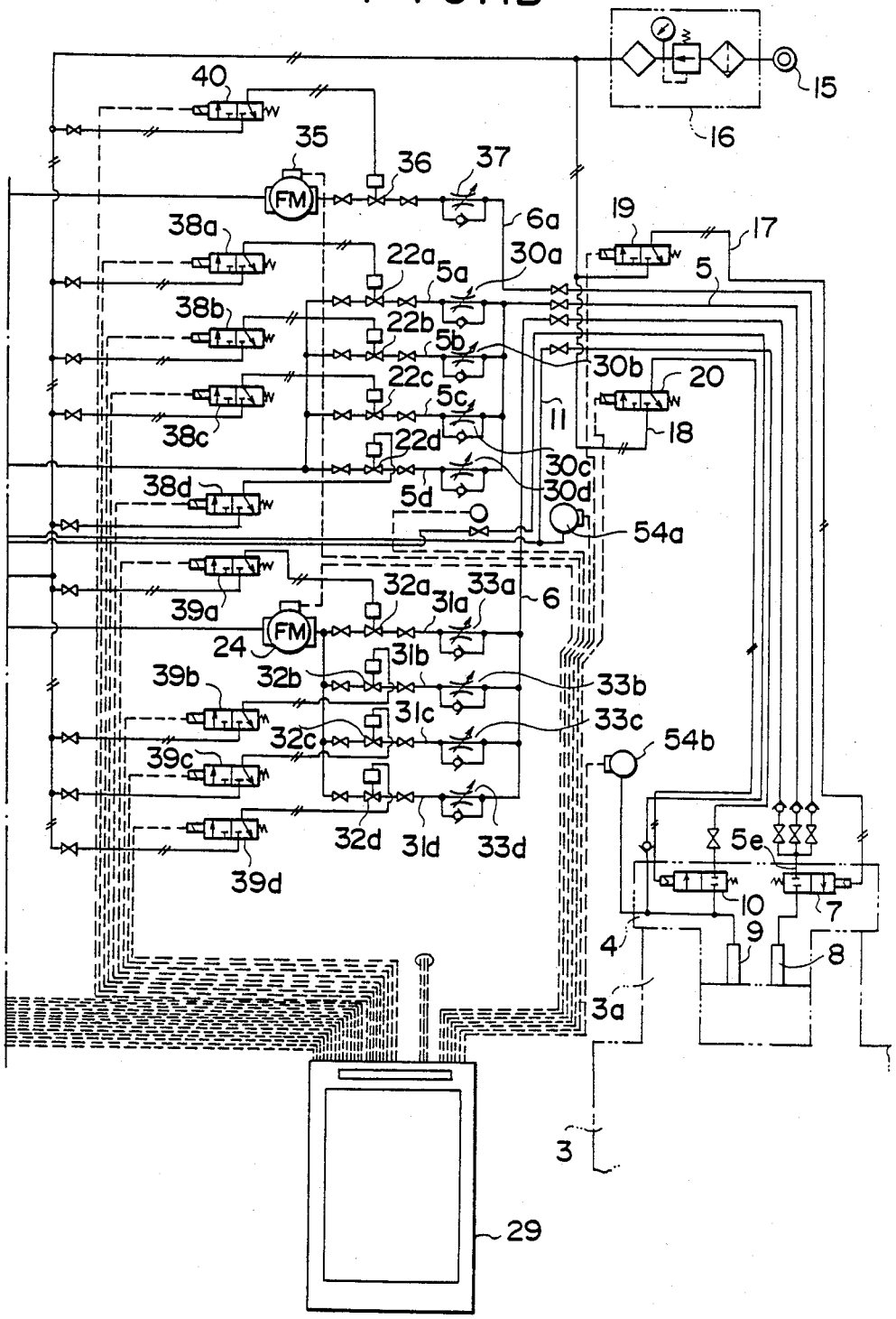

Referring to the drawings, particularly to FIG. 1, the apparatus shown therein includes a cooling water reservoir 1 and an anti-icing agent reservoir 2 respectively storing cooling water and anti-icing agent. There is further provided a filler head 4 which is adapted to be attached to a filler port 3*a* of a radiator 3 which constitutes a part of the engine cooling system. The filler head 4 is connected with the water reservoir 1 through a water supply conduit 5 and with the anti-icing agent reservoir 2 through an anti-icing agent supply conduit 6. In the filler head 4, there is provided a shut-off valve 7 and the conduits 5 and 6 are connected through this valve 7 with a discharge port 8 formed in the head 4. The illustrated embodiment further includes on anti-corrosion agent reservoir 2*a* which is connected through a conduit 6*a* with the valve 7. Thus, the conduit 6*a* is also connected through the valve 7 with the discharge port 8. As shown in FIG. 1, the conduits 5, 6 and 6*a* are connected to a single conduit 5*e* which is in turn connected with the valve 7. This arrangement is advantageous in that the valve 7 can be simplified because the number of valve ports can be decreased.

The filler head 4 is further formed with a suction port 9 which is connected with a suction conduit 11 through a shut-off valve 10 provided in the head 4. Above the water reservoir 1, there is a vacuum tank 12 which is connected through a vacuum line 13 with a vacuum pump 14. The vacuum tank 12 is connected with the upper portion of the water reservoir 1 snd the suction conduit 11. In the suction conduit 11, there is provided a pressure detector 54*a*. A second pressure detection 54*b* is provided in the line between the suction port 9 and the valve 10. The valves 7 and 10 are of pneumatically operated type and, for operating the valves 7 and 10, there is provided an air pressure source 15 connected through a pressure regulator 16 and air pressure lines 17 and 18 to the valves 7 and 10. The air pressure line 17 leading to the valve 7 has a solenoid valve 19 so that the line 17 is opened when the solenoid valve 19 is energized to supply the air pressure to the valve 7 to thereby open the conduits 5, 6 and 6*a* to the discharge port 8. Similarly, the air pressure line 18 has a solenoid valve 20 which is adapted to be energized to open the line 18 to thereby actuate the valve 10 and connect the suction conduit 11 to the suction port 9. The suction port 9 and the suction conduit 11 function to exhaust the air in the radiator 3 and the other parts of the engine cooling system in accordance with the quantity of the liquid supplied through the discharge port 8 to the engine cooling system to thereby prevent pressure increase in the cooling system. There are further provided a vacuum detector 54*a* which detects the vacuum pressure at the tank 12 and a pressure detector 54*b* which detects the pressure at the port 9.

In the water conduit 5, there is provided a water pump 21 and parallel branch lines 5*a*, 5*b*, 5*c* and 5*d* are provided downstream of the pump 21. The branch line 5*a* has a shut-off valve 22*a* and a flow restriction 30*a*. Similarly, the branch lines 5*b*, 5*c* and 5*d* have shut-off valves 22*b*, 22*c* and 22*d*, respectively, and flow restrictions 30*b*, 30*c* and 30*d*, respectively. The valves 22*a*, 22*b*, 22*c* and 22*d* are of pneumatically operated type and solenoid valves 38*a*, 38*b*, 38*c* and 38*d* are provided for actuating the valves 22*a*, 22*b*, 22*c* and 22*d* respectively. The flow restrictions 30*a*, 30*b*, 30*c* and 30*d* are of different size and function to control the flow rates through the lines 5*a*, 5*b*, 5*c* and 5*d* respectively. The flow restrictions are selectively used in accordance with desired concentrations of the additives. In the illustrated embodiment, the restrictions 30*a*, 30*b*, 30*c* and 30*d* have effective passage areas which decrease in this order.

The anti-icing agent conduit 6 is provided with a supply pump 23 and a flowmeter 24 which detects the quantity of liquid supplied through the conduit 6. The conduit 6 is provided downstream of the flowmeter 24 with parallel branch lines 31*a*, 31*b*, 31*c* and 31*d* which respectively have pneumatically operated valves 32*a*, 32*b*, 32*c* and 32*d* and flow restrictions 33*a*, 33*b*, 33*c* and 33*d* of different size. In order to control the supply of actuating air pressure to the valves 32*a*, 32*b*, 32*c* and 32*d*, there are provided solenoid valves 39*a*, 39*b*, 39*c* and 39*d* so that desired one of the flow restrictions can be selectively used by selectively energizing the solenoid valves, to thereby control the flow rate of the anti-icing agent through the conduit 6. In this embodiment, the restrictions 33*a*, 33*b*, 33*c* and 33*d* have effective passage areas which increase in this order. The restrictions 30*a*, 30*b*, 30*c* and 30*d* and the restrictions 33*a*, 33*b*, 33*c* and 33*d* are used in pairs, respectively. Specifically, for providing a coolant of 20% anti-icing agent concentration, the restrictions 30*a* and 33*a* are used. Similarly, for coolants of anti-icing agent concentrations of 35%, 45% and 55%, the pairs of the restrictions 30*b* and 33*b*, 30*c* and 33*c*, and 30*d* and 33*d* are respectively used.

The anti-corrosion agent conduit 6*a* has a supply pump 34, a flowmeter 35 which detects the quantity of liquid supplied through the conduit 6*a*, and a shut-off valve 36. Further, the conduit 6*a* may be provided with a flow restriction 37 if required. In order to control the supply of actuating air pressure to the valve 36, there is provided a solenoid valve 40. In the water reservoir 1, there are provided water level gauges 25 and 26. The reservoir 2 is provided with level gauges 27 and 28.

Figure 2:
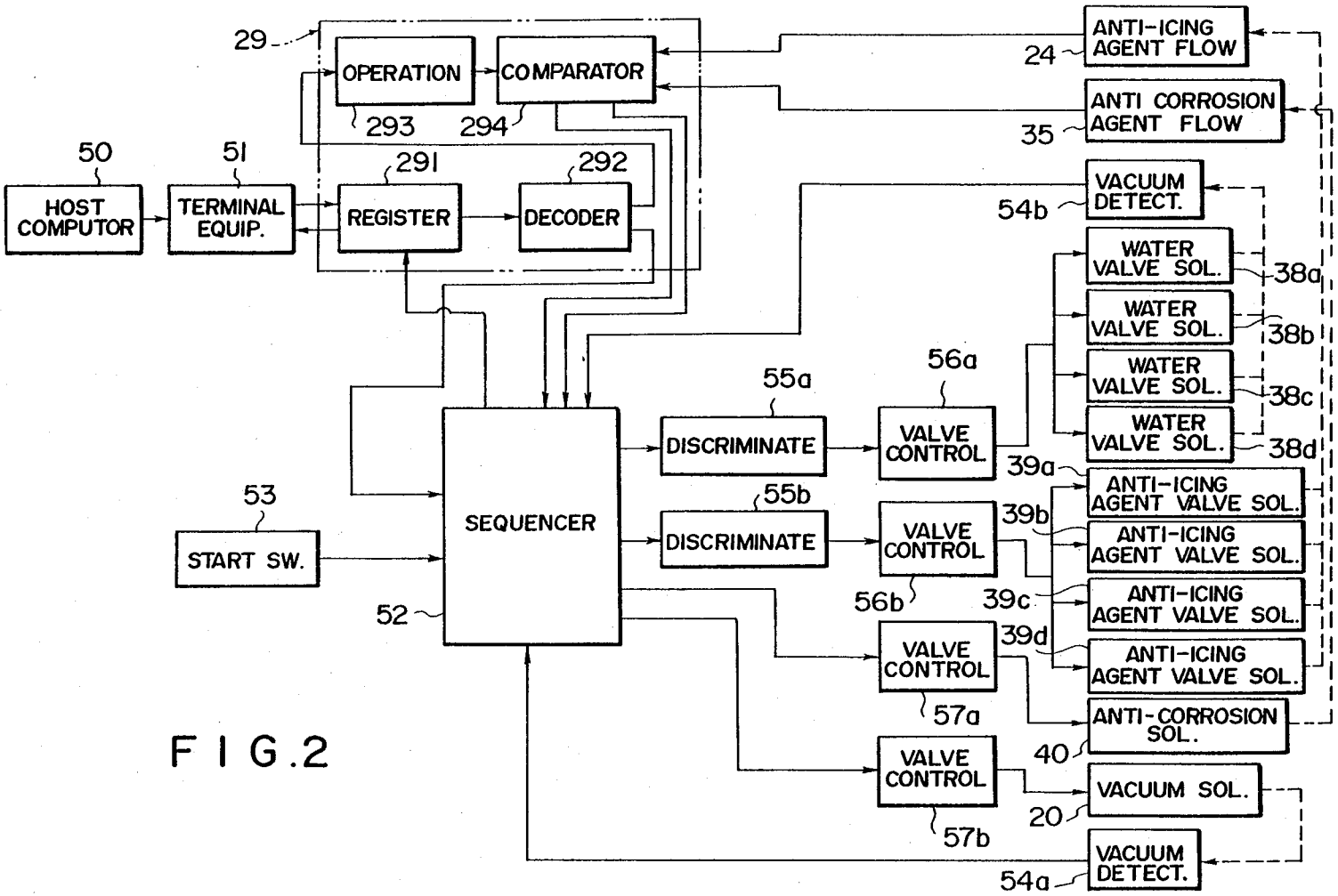
FIG. 2 is a block diagram showing details of the control means.

For the purpose of controlling the solenoid valves, there is provided an electronic control circuit 29 which is shown in detail in FIG. 2. The control circuit 29 includes a register 291, a decoder 292, an operation circuit 293 and a comparator 294. The register 291 has an input connected through a terminal equipment 51 with a host computor 50 so as to receive signals representing information on the types of the automobiles, the types of the engines mounted on the automobiles, the destinations, and so on. The register 291 stores the signals in the order which is in conformity with the order under which the automobiles are transferred.

There is provided a sequencer 52 having a start switch 53 for providing a start signal to the sequencer 52. The sequencer 52 functions to apply an access signal to the register 291 so as to make the register 291 start to apply its output to the decoder 292. Further, the sequencer 52 receives signals from the decoder 292, the comparator 294 and the detectors 54*a* and 54*b* to sequentially produce signals for controlling the supply of water and anti-icing agent, and evacuation of the engine cooling system.

The sequencer 52 has outputs connected with discriminating circuits 55*a* and 55*b* which are respectively connected with valve operating circuits 56*a* and 56*b*. The discriminating circuits 55*a* and 55*b* discriminate the signals from the sequencer 52 and, when the signal from the sequencer 52 is for the water supply, the circuit 55*a* passes the signal to the valve operating circuit 56*a* whereas the signal for the anti-icing agent supply is passed through the circuit 55*b* to the valve operating circuit 56*b*. The valve operating circuits 56*a* and 56*b* function to supply energizing currents to selected ones of the solenoid valves 38*a*, 38*b*, 38*c* and 38*d*; 39*a*, 39*b*, 39*c* and 39*d*. The sequencer 52 further supplies its outputs valve operating circuits 57*a* and 57*b* which are respectively connected with the solenoid valve 40 and the solenoid valve 20.

When an automobile is transferred to the cooling water charging station, the filler head 4 is connected with the filler port 3*a* of the radiator 3 on the automobile through a manual operation and the start switch 53 is actuated to make the sequencer 52 issue the access signal to the register 291 so as to take out the signals corresponding to the specific automobile which is in the cooling water charging station. The register 291 functions under the access signal from the sequencer 52 to issue as its output the signal memorized in the most preceeding address and fill a vacant address with new signal taken from the terminal equipment 51.

The decoder 292 is connected to receive the signals from the register 291 and decodes the signals to produce signals corresponding to the volumetric capacity of the engine cooling system and the concentration of the additives such as the anti-icing agent and the anti-corrosion agent. The output of the decoder 292 is applied to the operation circuit 293 which calculates the quantities of the anti-icing agent and of the anti-corrosion agent if required. The operation circuit 293 thus produces signals representing the quantity of the anti-icing agent to be supplied to the engine cooling system as well as the quantity of the anti-corrosion agent. The outputs of the operating circuit 293 are applied to the comparator 294 to be stored therein as reference values.

The output of the decoder 292 corresponding to the concentration of the anti-icing agent is also passed to the sequencer 52 which transmits the signal to the valve operating circuit 57*b* to evacuate the engine cooling system. More precisely, the circuit 57*b* applies an energizing signal to the solenoid valve 20 to open the same so that the air in the engine cooling system is drawn. When the pressure in the engine cooling system decreases to a predetermined value, the pressure decrease is detected by the detector 54*a* and a signal is applied to the sequencer 52. The sequencer 52 then functions to apply a stop signal to the valve operating circuit 57*b* to thereby de-energize the solenoid valve 20.

The sequencer 52 receives outputs from the comparator 294 and transmits the water quantity signal, the anti-icing agent signal and the anti-corrosion agent signal to the discriminating circuits 55*a* and 55*b* and to the valve operating circuit 57*a*, respectively. The discriminating circuits 55*a* and 55*b* discriminate the signals applied thereto to select appropriate ones of the valves 38*a* through 38*d* and of the valves 39*a* through 39*d*, and transmit the signals to the valve operating circuits 56*a* and 56*b*, respectively. The valve operating circuits 56*a* and 56*b* apply energizing currents to the selected solenoid vales in accordance with the signals received from the discriminating circuits 55*a* and 55*b*. For example, when a coolant having a 35% anti-icing agent concentration is to be provided, the solenoid valves 38*b* and 39*b* are energized to open the valves 22*b* and 32*b*, respectively, to supply water and anti-icing agent through the restrictions 30*b* and 33*b* with flow speed appropriate to form the 35% coolant. At the same time, the valve 40 is also energized when necessary to open the valve 36 so that the anti-corrosion agent is supplied to the engine cooling system.

The flows of the anti-icing agent and of the anti-corrosion agent are continuously detected by the flow detectors 24 and 35 and the flow signals are applied from the detectors 24 and 35 to the comparator 294. When the amounts of flows as detected by the detectors 24 and 35 reach the reference values stored in the comparator 294, the comparator 294 produces end signals which are applied to the sequencer 52. The pressure detector 54*b* provided downstream of the valve 10 detects that the negative pressure in the engine cooling system is weakened to a predetermined value or to the atmospheric pressure to indicate that a predetermined quantity of liquids has been changed and produces a water supply end signal which is applied to the sequencer 52. The sequencer 52 then functions to produce stop signals which are applied to the discriminating circuits 55*a* and 55*b* and the valve operating circuit 57*a* to terminate the operation thereof. The flow restrictions 30*a* through 30*d* and the flow restrictions 33*a* through 33*d* are determined and paired so that the supplies of water and of the anti-icing agent are simultaneously started and substantially simultaneously terminated to obtain a coolant of a desired agent concentration. Therefore, it is possible to avoid local concentration of the anti-icing agent in the engine cooling system.

In the illustrated embodiment, the quantity of the coolant charged to the engine cooling system is detected in terms of the pressure in the system by the pressure detector 54*b*. This arrangement is advantageous in that the apparatus can be used for charging coolant to cooling systems of different capacities. Alternatively, the water flow may continuously be detected by the flowmeter 24 and an end signal may be applied to the sequencer 52 when a predetermined quantity of water is supplied to the engine cooling system to thereby terminate the operation of the valve operating circuit 56*a*. For this purpose, the operating circuit 293 may be modified to supply to the comparator 294 a signal representing the quantity of the water to be supplied to the engine cooling system and the signal from the flowmeter 24 is applied to the comparator 294 so that an end signal is produced when a predetermined quantity of water has been supplied.

In this embodiment, four water conduits and four anti-icing agent conduits are used for providing engine coolant of four different additive concentrations. It should however be noted that the number of conduits can be decreased. For example, three pairs of conduits may be pjovided for the coolants having additive concentrations of 20%. 45% and 55%, respectively for obtaining a coolant of 35% additive concentration, the conduits for the 45% concentration may be used for a certain period of time and then switched to the conduits for the 20% concentration to obtain a desired result.

Figure 3:
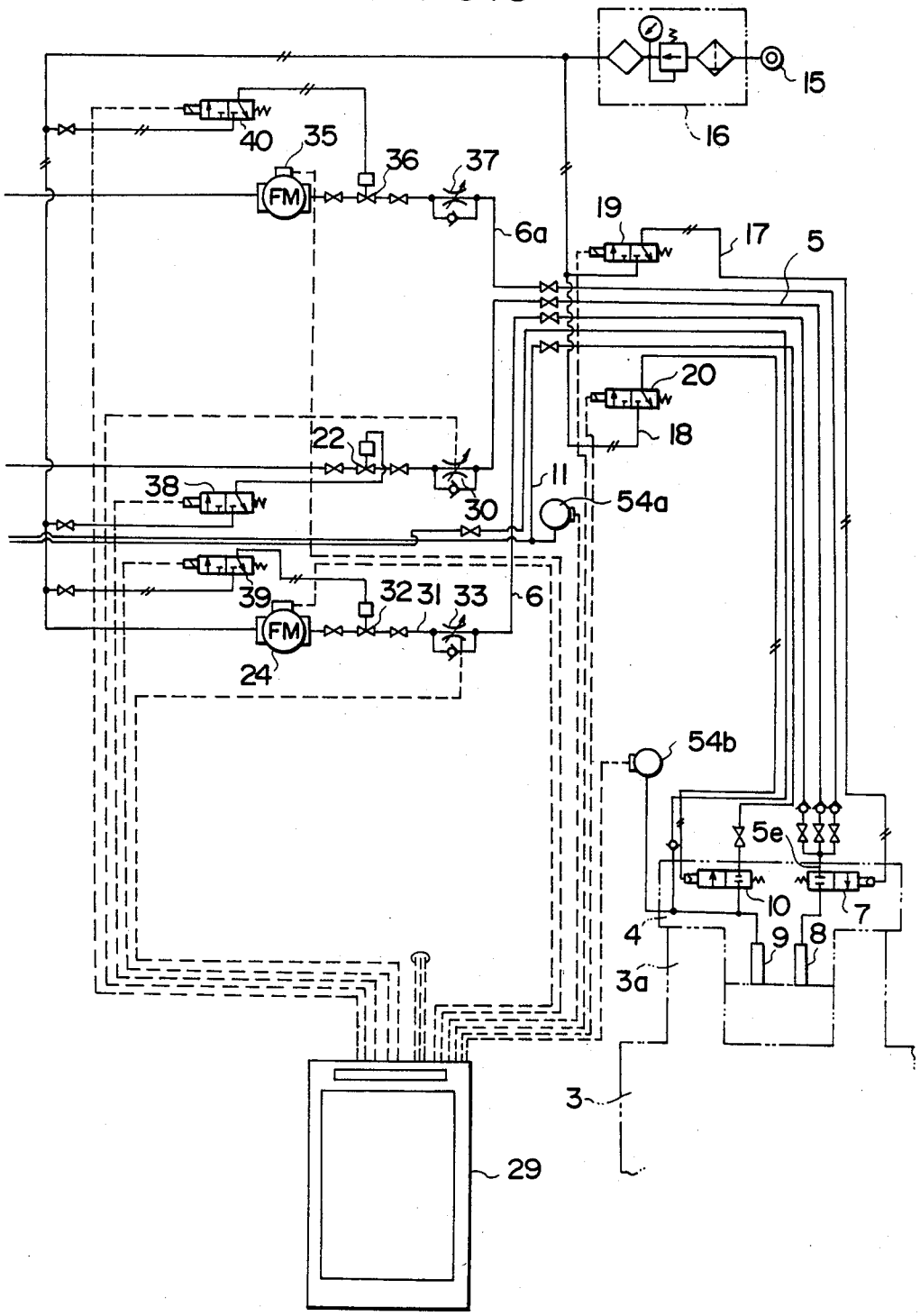
FIG. 3 is a diagram showing another embodiment of the present invention.

Referring to FIG. 3, the modification shown therein has a variable flow restriction 30 provided in the water supply conduit 5 and a variable restriction 33 provided in the anti-icing agent conduit 6. The control circuit 29 provides signals for controlling the variable restrictions 30 and 33 to thereby regulate the rates of flows of the cooling water and the additive in accordance with the capacity of the engine cooling system and the desired addive concentration. Alternatively the flow restrictions 30 and 33 may be omitted and instead the pumps 21 and 22 may be substituted by variable output type pumps such as variable speed pumps or variable displacement pumps so that flow rates of the cooling water and the anti-icing agent can be regulated through the controls of the pumps.

The invention has thus been shown and described with reference to a specific embodiment, however, it should be noted that the invention is in no way limited to the detailes of the illustrated arrangements but changes and modifications may be made without departing from the scope of the appended claims.

We claim:

1. An apparatus for charging a cooling liquid to an engine cooling system, said apparatus comprises additive reservoir means for storing at least one additive, cooling water reservoir means for storing cooling water, filler head means adapted to be connected with coolant inlet means of an automobile engine cooling system having a known volumetric capacity, additive conduit means extending between said additive reservoir means and said filler head means, cooling water conduit means extending between said cooling reservoir means, additive control means provided in said additive conduit means for controlling a quantity of the additive supplied to the engine cooling system in accordance with the capacity of the cooling system and a desired concentration of the additive, cooling water control means provided in said cooling water conduit means for controlling a quantity of the cooling water supplied to the engine cooling system in accordance with the capacity of the cooling system and the desired concentration of the additive, said additive control means includes additive flow measuring means to measure the quantity of the additive supplied to the engine cooling system, said cooling water control means including pressure detecting means for detecting a pressure in the engine cooling system, control circuit means being provided for terminating supply of the additive when a predetermined quantity is supplied and for terminating supply of the cooling water when the pressure in the engine cooling system has reached a predetermined value, whereby the cooling water is charged to the engine cooling system with the desired concentration of the additive.

2. An apparatus in accordance with claim 1 in which said additive control means includes means for controlling rate of supply of the additive so that additive supply time becomes substantially the same as cooling water supply time.

3. An apparatus in accordance with claim 2 in which said additive and cooling water control means include flow control valve means.

4. An apparatus in accordance with claim 2 in which said additive supply rate control means includes a plurality of parallel flow restrictions of different effective cross-sectional areas and flow control valve means for leading the additive to at least one of the flow restrictions, control circuit means being provided for operating the flow control valve means so that the additive is directed to selected one of the flow restrictions.

5. An apparatus in accordance with claim 2 in which said additive supply rate control means includes variable flow restriction means.

6. An apparatus in accordance with claim 1 in which said additive and cooling water control means include flow measuring means to measure quantities of the additive and the cooling water supplied to the engine cooling system and control circuit means for terminating supplies of the additive and the cooling water when predetermined quantities are supplied.

7. An apparatus in accordance with claim 1 in which said additive control means includes a plurality of additive flow restrictions of different effective cross-sectional areas, said cooling water control means including cooling water flow restrictions which are the same in number as said additive control means and paired with the respective ones of said additive flow restrictions, said additive and cooling water flow restrictions in each pair having effective cross-sectional areas which are so determined that an engine cooling liquid of a desired additive concentration is obtained when the additive and the cooling water are supplied through the paired restrictions for substantially the same period of time.

8. An apparatus in accordance with claim 1 in which said additive and cooling water control means include flow control pump means and control circuit means for controlling operations of the flow control pump means to regulate flow rates of the additive and the cooling water so that additive supply time becomes substantially the same as cooling water supply time.

9. An apparatus for charging a cooling liquid to an engine cooling system, said apparatus comprises additive reservoir means for storing at least one additive, cooling water reservoir means for storing cooling water, filler head means adapted to be connected with coolant inlet means of an automobile engine cooling system having a known volumetric capacity, additive conduit means extending between said additive reservoir means and said filler head means, cooling water conduit means extending between said cooling water reservoir means, additive control means provided in said additive conduit means for controlling a quantity of the additive supplied to the engine cooling system in accordance with the capacity of the cooling system and a desired concentration of the additive, cooling water control means provided in said cooling water conduit means for controlling a quantity of the cooling water supplied to the engine cooling system in accordance with the capacity of the cooling system and the desired concentration of the additive, said additive control means includes additive flow measuring means to measure the quantity of the additive supplies to the engine cooling system, said cooling water control means including pressure detecting means for detecting a pressure in the engine cooling system, control circuit means being provided for terminating supply of the additive when a predetermined quantity is supplied and for terminating supply of the cooling water when the pressure in the engine cooling system has reached a predetermined value, said control circuit means including operation means for performing operations to determine at least the quantity of the additive to be supplied to the engine cooling system based on the capacity of the engine cooling system and a desired concentration of the additive in the cooling water and operating said additive and cooling water supply control means so that the cooling water is charged to the engine cooling system with the desired concentration of the additive, whereby the cooling water is charged to the engine cooling system with the desired concentration of the additive.

10. An apparatus in accordance with claim 9 in which said additive control means includes a plurality of additive flow restrictions of different effective cross-sectional areas, said cooling water control means including cooling water flow restrictions which are the same in number as said additive control means and paired with the respective ones of said additive flow restrictions, said additive and cooling water flow restrictions in each pair having effective cross-sectional areas which are so determined that an engine cooling liquid of a desired additive concentration is obtained when the additive and the cooling water are supplied through the paired restrictions for substantially the same period of time.

* * * * *